United States Patent [19]

Flaith et al.

[11] 4,067,318

[45] Jan. 10, 1978

[54] DRYER CONVEYOR

[75] Inventors: George Donald Flaith, Philadelphia; K. A. George, Levittown, both of Pa.

[73] Assignee: Proctor & Schwartz, Inc., Philadelphia, Pa.

[21] Appl. No.: 718,920

[22] Filed: Aug. 30, 1976

Related U.S. Application Data

[63] Continuation-in-part of Ser. No. 642,291, Dec. 19, 1975, abandoned.

[51] Int. Cl.[2] ..... F26B 19/00

[52] U.S. Cl. ..... 34/208; 34/216; 34/225; 198/823

[58] Field of Search ..... 34/208, 210, 212, 215, 34/216, 217, 236, 225; 198/823; 432/59

[56] References Cited

U.S. PATENT DOCUMENTS

| | | | |
|---|---|---|---|
| 2,964,855 | 12/1960 | Fava | 198/823 |
| 3,069,786 | 12/1962 | Nichols, Jr. | 34/216 |
| 3,374,751 | 3/1968 | Werner | 198/823 |
| 3,556,286 | 1/1971 | Naito et al. | 198/823 |

*Primary Examiner*—Kenneth W. Sprague
*Assistant Examiner*—James C. Yeung
*Attorney, Agent, or Firm*—Richard H. Thomas

[57] ABSTRACT

This invention relates to a dryer particularly suitable for particulate matter having an endless conveyor in the form of a polyester fabric screen wherein the endless conveyor is normally flat but is given a trough-shape as it passes within the dryer to contain the particulate matter. Means are provided for moving the fabric screen through the dryer including an open support disposed beneath the fabric screen. Stationary, elongated trough-forming means within the dryer pick up the sides of the fabric to form and maintain the trough-shape, and stationary baffle plates within the dryer engage the trough-forming means to direct the flow of drying air through or against the matter being conveyed.

6 Claims, 6 Drawing Figures

DRYER CONVEYOR

This application is a continuation-in-part of prior application Ser. No. 642,291, filed Dec. 19, 1975, abandoned and assigned to assignee of the present application.

The present invention relates to a gas treating apparatus, and particularly to a novel dryer conveyor assembly suitable for conveying particulate material. The conveyor assembly of the present invention is of the endless flexible belt type having an elongated carrying run wherein means are provided for forming the belt in the carrying run into the shape of a trough.

Although the present invention will be described with reference to a dryer conveyor and treating of particulate material, it will be apparent that it has other applications, for instance in gas treating other than drying.

BACKGROUND OF THE INVENTION

A conventional method for transporting particulate or granular material through a dryer is on what is referred to as a pan conveyor. Each pan of the conveyor is provided with a perforated bottom, and air is caused to circulate within the dryer through said perforations and through the particulate material being conveyed in the pan conveyor.

A typical such pan conveyor is shown in prior U.S. Pat. No. 3,331,490 issued to Jeffrey Galion Manufacturing Company. A line of pans are arranged in succession carried by and between oppositely disposed chains, and the material being conveyed is carried within the pans. Individual pans are articulated with respect to each other so that the conveyor can bend around end driving sprockets and the like. The pans are provided with traveling sides or guards which are welded to the perforated bottom to contain the particulate material, and also to engage stationary baffle plates or gaurds within the dryer. Thus, the drying air is directed through the particulate material. Wear resistant seals are provided between the traveling guards and the stationary baffles to seal the air flow.

The sides of successive pans are not connected together, but are instead in sliding overlapping engagement because of the larger turning radius required for the sides around the end sprockets. One problem with this construction, and all pan conveyors, is the complexity and cost of the construction. In addition, the pan conveyors are heavy, requiring heavy-duty sprockets and other components. Further, their design obviously requires a large turning radius around the conveyor sprocket centers resulting in a bulky dryer construction.

Another known practice related to conveyor dryers is to use a metallic screen or perforated sheet metal conveyor as disclosed in prior U.S. Pat. No. 2,732,631, the drying being affected by the passage of hot air throgh and/or across the conveyor. In order to seal the flow of air across material on the conveyor, stationary wear resistant guards are provided extending between a dryer hood and the metallic screen.

It is known to provide in a baking oven a conveyor having a carrying run wherein the conveyor is a flat, flexible belt. The conveyor apparatus is provided with means for forming the belt into the shape of a trough. Such a construction is shown in prior U.S. Pat. No. 3,374,751. The conveyor flexible belt in this patent is impervious to the flow of air therethrough, and in fact, the conveyor assembly is provided with a horizontal bed or table beneath the conveyor flexible belt to support the same in its path of travel through the oven. Thus, even if the belt were pervious, this supporting plate would prevent the flow of air through the belt. Without the plate, the belt would be incapable of supporting relatively heavy loads.

Examples of other conveying apparatus comprising flexible belts and means to form the belts into troughs are shown in the following patents: British Pat. No. 661,027; Polish Pat. No. 47,517; U.S. Pat. No. 2,998,121; U.S. Pat. No. 3,381,799; U.S. Pat. No. 3,734,271; U.S. Pat. No. 3,627,111; and French Pat. No. 631,898.

The British Pat. No. 661,027 shows a conveyor belt which is supported by a plurality of spaced-apart slats, the belt being fastened to the slats with a plurality of rivets. The rivets are spaced inwardly from the sides of the belt allowing the belt sides to be turned up by guides to form a trough. The conveyor belt assembly of this patent would not be useful in a dryer for drying particulate material by the flow of drying air through the material since the belt shown in the patent is impervious to the flow of air.

Polish Pat. No. 47,517 appears to show a structure similar to that of the British patent. The conveyor belt of this patent also appears to be impervious to the flow of air through it.

U.S. Pat. No. 2,998,121 shows a guide arrangement in which a conveyor belt is supported by a plurality of spaced-apart rollers. Again, the belt shown is impervious to the flow of air through it and would not be suitable for the type of dryer to which the present invention is directed.

The remaining patents simply show a plurality of various guide mechanisms for forming a flexible belt into a trough.

SUMMARY OF THE INVENTION

The present invention relates to an apparatus for drying particulate matter comprising in combination a housing having an exit end and an entrance end; means for supplying heated air to said housing; a closed path conveyor assembly having a carrying run; said conveyor assembly including an endless, normally flat, resilient, flexible, moving fabric screen; an open support for said screen; means for moving said screen through said housing; a trough-forming means within said housing for deforming the edges of said fabric screen upward to form said screen into a trough, said fabric screen returning to its inherent flat condition upon passing out of said housing; said housing including a stationary baffle means engaging said trough-forming means for sealing the flow of drying air so that the same passes through or is directed against the fabric screen in said carrying run.

In an embodiment of the present invention, the open support for the fabric screen comprises a plurality of spaced-apart, transverse supporting slats extending beneath the fabric screen in turn supported by an endless sprocket chain traveling on elongated support tracks on opposite sides of the dryer. The fabric screen is affixed to the slats by fastening means spaced inwardly from the screen edges to permit deforming of the screen edges.

For purposes of the present application, an open support is one which supports the fabric screen but at the same time permits the flow of treating medium through the support and screen. Open support means other than slats can be employed, for instance a heavy wire mesh support, a plurality of moving perforated or foraminous plates, or a stationary perforated plate.

Preferably, the fabric screen is made of a polyester material.

By the present invention, not only is there a substantial saving in the cost of the conveyor assembly, but in addition there is a substantial saving in space, as compared to the conventional pan conveyor, by virtue of the short turning radius permitted at the end sprockets of the closed path, endless made possible by the use of a flexible fabric. In addition, the use of a polyester material as the fabric screen avoids high temperature fatigue experienced with conventional metal fabrics.

The invention and advantages thereof will become more apparent upon consideration of the following specification and appended claims, particularly with reference to the accompanying illustrative drawings setting forth a preferred embodiment thereof.

Figure 1:
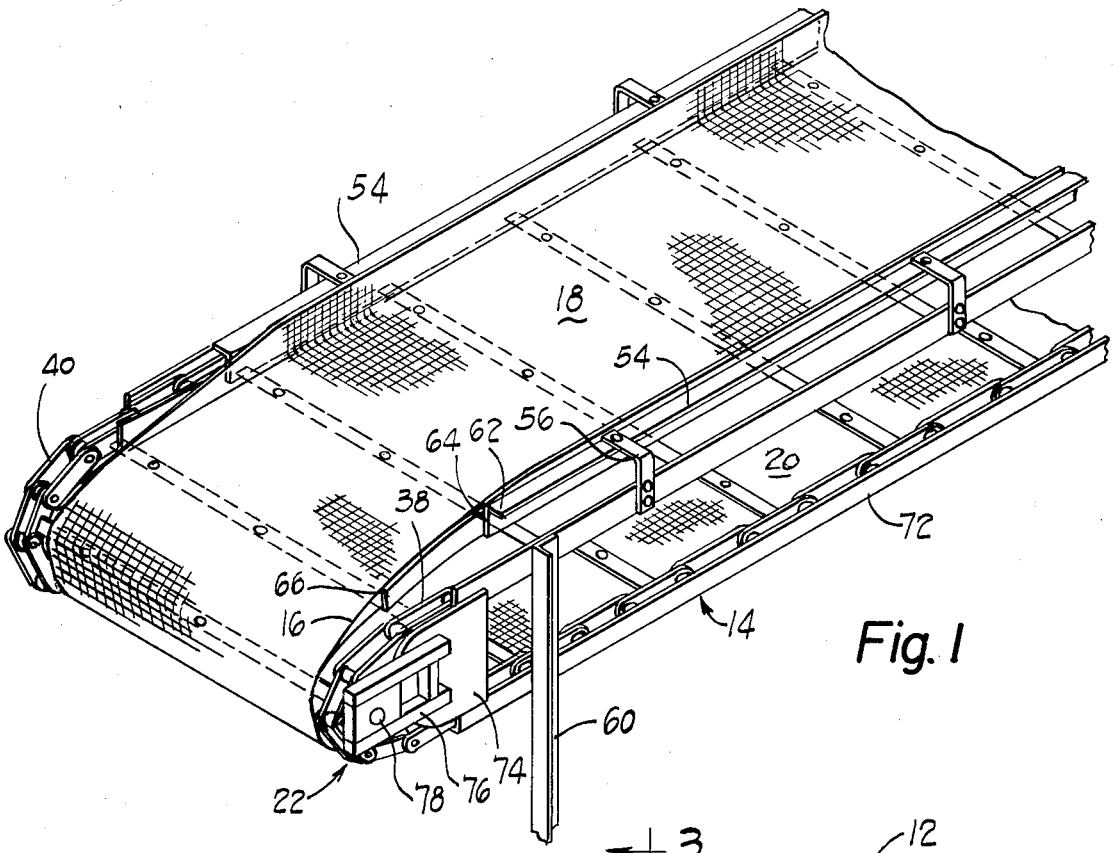
FIG. 1 is a perspective, three-dimensional view of a conveyor assembly incorporating the concepts of the present invention.
Figure 2:
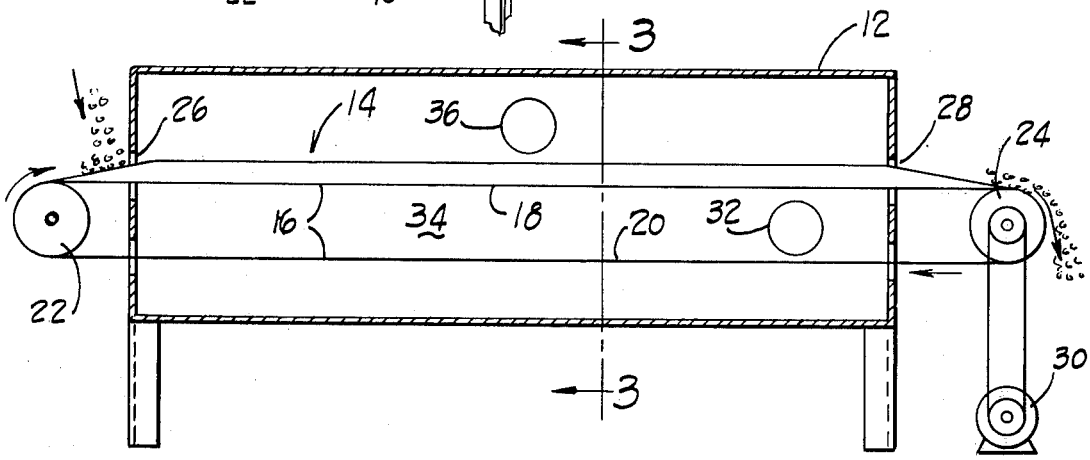
FIG. 2 is a side, elevation, section view of a dryer apparatus incorporating the conveyor assembly of FIG. 1.
Figure 3:
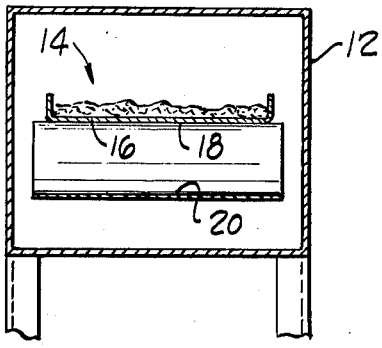
FIG. 3 is a section view taken along line 3—3 of FIG. 2.

Referring to the drawings, and in particular FIGS. 1-3, there is shown a drying apparatus comprising a dryer housing 12 (FIGS. 2 and 3) and a conveyor assembly 14 tracing a closed path through the housing. The conveyor assembly includes a normally flat, moving, resilient, flexible belt 16, preferably a polyester fabric screen defining an upper carrying run 18 and a lower run 20. The movable belt is carried at each end on suitable sprockets 22 and 24 by which the belt enters the dryer housing 12 at entrance end 26, exiting at exit end 28. It is understood that this system of belt entrainment is merely illustrative and that other specific systems may be utilized if so desired. Drive means 30 is provided for driving one of the flexible belt sprockets causing the flexible belt to move in its circuitous path.

The dryer housing may be any conventional unit with means, for instance a duct inlet 32, for introducing drying air into a plenum chamber 34 (FIG. 2) between the conveyor belt carrying and lower runs with exhaust means 36 above the belt for drawing drying air through the conveyor belt carrying run 18 and material conveyed thereon. Suitable baffles, not shown in these Figures direct the flow of air so that is passes through the carrying run. It is, of course, understood that the flow of air can be downwardly through the particulate material being dried, or can be simply directed at the particulate material.

The essence of the present invention lies in the precise nature of the conveyor assembly, particularly in the structure of the conveyor belt, which as indicated preferably is of a polyester fabric material, and in the mannr in which the belt passes through the dryer. Concerning the former, the conveyor belt polyester fabric screen 16 can vary substantially with regard to web thickness and mesh size, depending upon the nature and size of the material to be conveyed and dried, conditions within the dryer, and also on the amount of particulate material to be dried.

Figure 4:
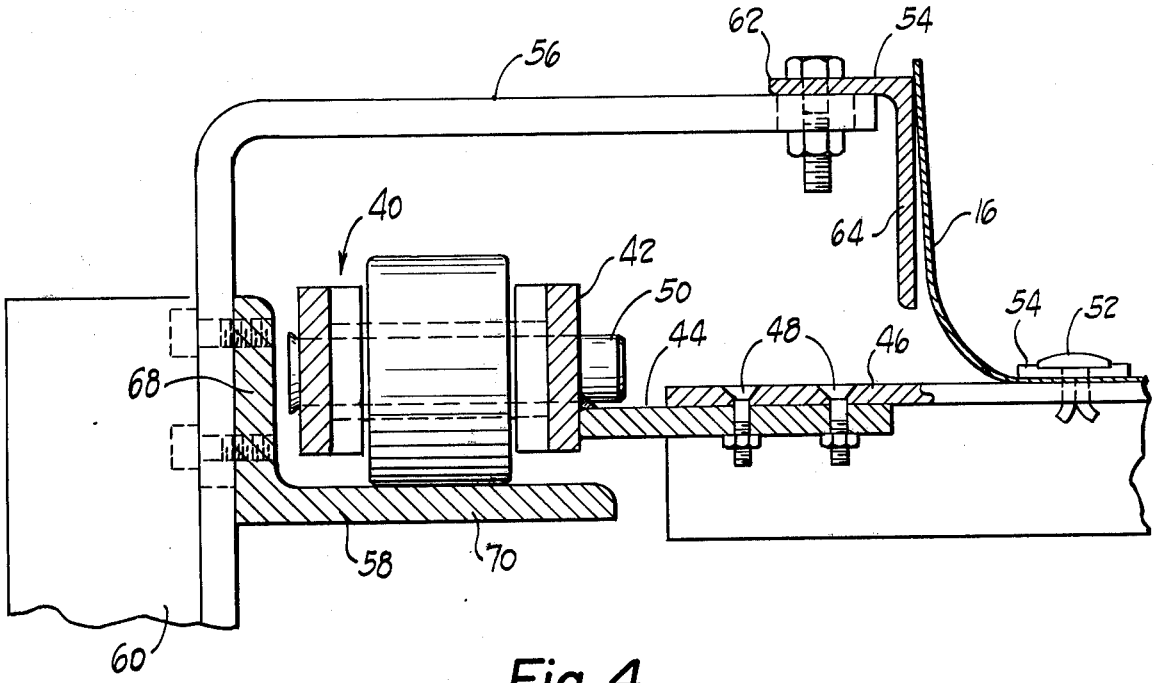
FIG. 4 is a detailed section view of one side of the conveyor assembly of FIG. 1.

Details with regard to the manner in which the conveyor belt passes through the dryer can be found in FIGS. 1 and 4 of the drawings. The conveyor assembly comprises a pair of side sprocket chains 38 and 40 which have formed, on certain inner links 42 (FIG. 4), at suitable distances along the length of the chains, right angle lugs 44 (FIG. 4) on which are mounted a plurality of transverse slats 46. The slats are affixed to the lugs 44 by means of threaded screws 48. The lugs 44 and slats 46 are arranged so that the slats are slightly below (in the view shown in FIG. 4) the plane of the axes of the pivot pins 50 of the sprocket chains 38, 40. The flexible conveyor belt 16 then is connected to the slats by a plurality of rivets 52, provided with washers 54 to reduce wear on the fibric screen. In the embodiment shown, referring to FIG. 1, three rivets are employed to affix the belt to each slat. Also, as shown in FIGS. 1 and 4, the endmost rivets (on opposite sides of the belt) are positioned inwardly from the ends of the slats (and from the sides of the belt) a predetermined amount to permit the fabric screen or belt to be picked up and formed into a trough. The amount of the spacing between the belt sides and the endmost rivets is dependent upon the height of the trough sides desired.

Details of the trough-forming assembly of the present invention are best illustrated in FIGS. 1 and 4. The main components of the assembly are elongated guards 54 in the shape of L-shaped flanges disposed on opposite sides of the conveyor assembly extending longitudinally through the dryer. Each guard is supported by a plurality of L-shaped brackets 56, which in turn are supported by L-shaped frame track sections 58 (FIG. 4) extending longitudinally along opposite sides of the conveyor assembly. The frame sections in turn are supported by upright legs 60 of the assembly. As illustrated in FIGS. 1 and 4, the guards 54 have a horizontal, outwardly extending surface 62 to which the supporting brackets are affixed, and a downwardly extending, inwardly facing surface 64 against which the belt trough sides ride. A flaring end section 66 is affixed to each downwardly extending surface 64, at the entrance end 26 of the dryer. The sections 66 are flared outwardly to pick up the opposite sides of the fabric screen 16 as the screen leaves sprocket 22 at the entrance end of the dryer housing. The flared end sections terminate at about the point where the fabric screen leaves the sprocket 22 and are flared outwardly to points just short of the sides of the fabric screen.

As best shown in FIG. 4, the frame track section 58 is provided with an upwardly extending surface 68, which is affixed to the upright legs 60 of the conveyor assembly, and a horizontally extending surface 70 which provides the upper run for the sprocket chain 40. The sprocket chain 38 along the opposite side of the assembly is similarly supported. The lower runs for the sprocket chains are provided by similar frame sections 72 (FIG. 1) also affixed to the legs 60 for the conveyor assembly and also provided with horizontal and vertical surfaces, the horizontal surfaces providing the support means or runs for the sprocket chains.

Figure 5:
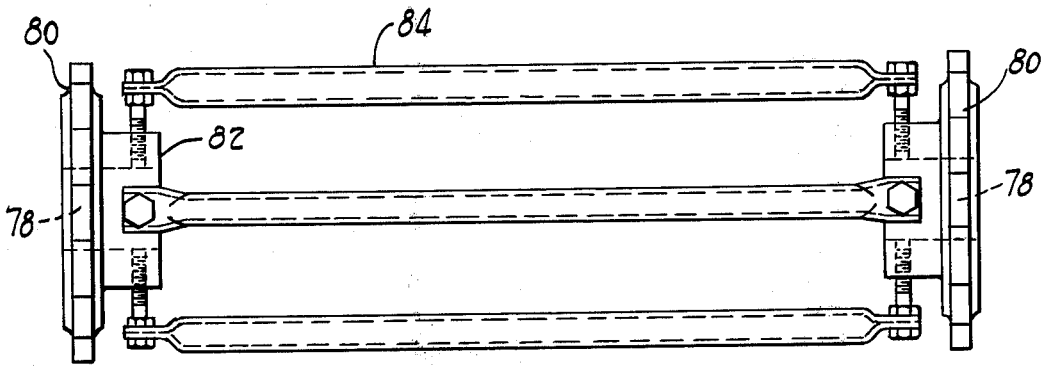
FIG. 5 is an elevation, partial end view illustrating the sprocket apparatus for the conveyor assembly of FIG. 1.

The end sprockets 22 and 24 are best shown in FIGS. 1 and 5. As shown in FIG. 1, the end sprocket 22 is supported on a plate 74 which is welded between the outboard free ends for the frame sections 58 and 72. A bracket 76 then supports the main bearing 78 for the sprocket 22.

As shown in FIG. 5, each sprocket comprises a toothed gear 80 rotating on each bearing center 78. Attached to the toothed gear is a rotor 82 on which a plurality of transverse frame members or girts 84 are supported. These frame members or girts are spaced from the bearing center a distance approximately equal to the radius of the toothed gear so that the fabric 16 follows approximately the same path around the sprocket 22 as the sprocket chains 38 and 40.

Preferably, the cross girts are kept about one-eighth inch below the centerline of the conveyor chain when going around the sprockets 22 and 24 to keep the fabric screen slack and to compensate for differences in coefficient of thermal expansion of the steel frame and fabric screen.

Figure 6:
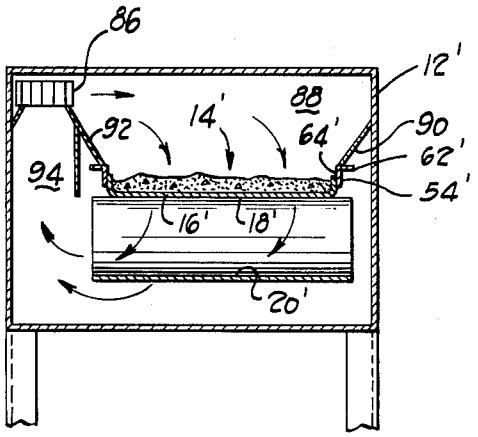
FIG. 6 is a section view of a conveyor assembly and dryer in accordance with an embodiment of the present invention.

The embodiment of FIG. 6 illustrates a baffle arrangement within the dryer which may be employed for directing the drying air or other treating medium through or against the material being conveyed on the conveyor carrying run. The dryer is provided with a circulation fan 86 which directs the drying air into a plenum chamber 88 above the conveyor carrying run. The plenum chamber is defined by stationary, sloped baffles or guards 90 and 92, on opposite sides of the conveyor assembly, which extend longitudinally through the length of the dryer. The left-hand baffle or guard 92 extends upwardly to the underside of the circulation fan housing to seal the plenum chamber 88 from a return air chamber 94 which is in fluid communication with the inlet of the circulation fan. Suitable heating means (not shown) imparts heat to the drying air. Also, to seal the plenum chamber 88 from the rest of the dryer and to insure that the drying air passes through or against the material being conveyed, the lower edges of the guards 90 and 92 engage the horizontal surfaces 62' of the side guards 54'. As the guards 54' are substantially coextensive with the baffles 90 and 92, it is apparent that the folded sides of the conveyor screen engaging surfaces 64' of the guards 54' seal the air flow. The components identified by numbers 62', 54' and 64' are the same as those in FIGS. 1 and 3 identified by the numbers 62, 54 and 64.

Advantages of the present invention will be apparent. The smaller sprocket chains and smaller diameter sprockets required in the conveyor assembly of the present invention make the conveyor compact, thus enabling installation of multiple conveyors in a limited space. The fabric screen 16 being flexible permits its being folded up along its sides to form the side guards or troughs, thus eliminating the need for the usual traveling guards. In addition to containing the material being treated, the folded sides effectively seal the air flow within the dryer so that it passes through the material. The use of polyester material for the fabric screen permits its use up to 325° F. and higher. The fabric screen, prior to installation on the conveyor is heat set at about 350° F. to eliminate later shrinkage.

What is claimed is:

1. Apparatus for treating matter comprising in combination a housing having an exit end and an entrance end;

means for supplying a treating medium to said housing;

a closed path conveyor means having an upper carrying run;

said conveyor means including an endless, normally flat, one-piece, resilient, flexible, moving fabric screen;

support means for the fabric screen in said upper carrying run;

means for moving said fabric screen through said housing; and longitudinally extending trough-forming means for deforming the edges of said fabric screen upward to form said screen into a trough for substantially the length of said carrying run, said fabric screen returning to its inherent flat condition at the end of the carrying run;

said housing including stationary baffle means extending longitudinally within the dryer in sealing engagement with the trough-forming means whereby, in addition to containing the matter being treated, in the carrying run, the fabric screen sides effectively seal the treating medium flow such that the same passes through or is directed against said matter.

2. The apparatus of claim 1 wherein said fabric screen is a polyester fabric, and said apparatus is a dryer.

3. The apparatus of claim 2 wherein the matter being treated is particulate matter and wherein said fabric has a mesh size sufficiently small to retain said particulate matter but sufficiently large to permit the flow of the drying gas through said fabric screen and particulate matter.

4. Apparatus for drying particulate matter comprising in combination a housing having an exit end and an entrance end;

means for supplying a drying gas to said housing;

a closed path conveyor means having an upper run;

means for moving said drying gas through said housing so that it passes through said conveyor means upper run;

said conveyor means including an endless, normally flat, one-piece, resilient, flexible, moving fabric screen;

a plurality of spaced-apart supporting slats transverse to said fabric screen;

fastening means holding said fabric screen to said slats, said fastening means being spaced inwardly from the side edges of the fabric screen;

means for moving said fabric screen through said housing including means for supporting said slats at the ends thereof;

means within said housing and adjacent the entrance end of the housing for deforming the edges of said fabric screen upward to form said screen into a trough, said fabric screen returning to its inherent flat condition upon passing out of said housing.

5. The apparatus of claim 4 wherein said fabric screen is a polyester fabric.

6. The apparatus of claim 5 wherein said fabric has a mesh size suffficiently small to retain said particulate matter but sufficiently large to permit the flow of the drying gas through said fabric screen and particulate matter.

* * * * *

UNITED STATES PATENT AND TRADEMARK OFFICE

CERTIFICATE OF CORRECTION

PATENT NO. : 4,067,318

DATED : January 10, 1978

INVENTOR(S) : George Donald Flaith and K. A. George

It is certified that error appears in the above-identified patent and that said Letters Patent are hereby corrected as shown below:

Col. 1, line 39, change "gaurds" to --guards--. Col. 3, line 11, after "endless" insert --screen--; line 59, before "passes" change "is" to --it--. Col. 4, line 21, change "fibric" to --fabric--. Col. 6, line 61, in claim 6, after "mesh size" change "suffficiently" to --sufficiently--.

Signed and Sealed this

*Ninth* Day of *May 1978*

[SEAL]

*Attest:*

RUTH C. MASON
*Attesting Officer*

LUTRELLE F. PARKER
*Acting Commissioner of Patents and Trademarks*